US011898549B2

(12) United States Patent
Mohr et al.

(10) Patent No.: US 11,898,549 B2
(45) Date of Patent: Feb. 13, 2024

(54) DOSING PUMP WITH DOSING DIAPHRAGM

(71) Applicant: ProMinent GmbH, Heidelberg (DE)

(72) Inventors: Marc Mohr, Mannheim (DE); Roland Elgetz, Eppelheim (DE); Martin Reinhard, Heidelberg (DE)

(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 17/120,686

(22) Filed: Dec. 14, 2020

(65) Prior Publication Data

US 2021/0190050 A1 Jun. 24, 2021

(30) Foreign Application Priority Data

Dec. 19, 2019 (DE) ..... 10 2019 135 153.7

(51) Int. Cl.

| | |
|---|---|
| ***F04B 43/06*** | (2006.01) |
| ***F04B 13/00*** | (2006.01) |
| ***F04B 43/02*** | (2006.01) |
| ***F04B 43/00*** | (2006.01) |
| ***F04B 43/067*** | (2006.01) |
| ***F04B 43/14*** | (2006.01) |

(Continued)

(52) U.S. Cl.

CPC ..... *F04B 43/06* (2013.01); *F04B 13/00* (2013.01); *F04B 43/0054* (2013.01); *F04B 43/02* (2013.01); *F04B 43/043* (2013.01); *F04B 43/067* (2013.01); *F04B 43/073* (2013.01); *F04B 43/107* (2013.01); *F04B 43/14* (2013.01)

(58) Field of Classification Search

CPC ..... F04B 43/02; F04B 43/0054; F04B 43/06; F04B 43/067; F04B 43/073; F04B 43/043; F04B 43/107; F04B 43/14; F04B 13/00

See application file for complete search history.

(56) References Cited

U.S. PATENT DOCUMENTS 3,218,978 A * 11/1965 Kalert, Jr. ..... F02M 1/00 261/DIG. 68
3,386,388 A * 6/1968 Rosenberg ..... F04B 7/0275 417/395

(Continued)

FOREIGN PATENT DOCUMENTS

DE 1748189 U 7/1957
DE 3151764 A1 9/1982

(Continued)

*Primary Examiner* — Peter J Bertheaud
(74) *Attorney, Agent, or Firm* — PAUL & PAUL

(57) ABSTRACT

The present invention concerns a dosing pump comprising a dosing chamber, a working chamber and a dosing diaphragm, wherein the dosing chamber and the working chamber are separated from each other by the dosing diaphragm, wherein there is provided a device for reciprocating movement of the dosing diaphragm between a first position and a second position, wherein the volume of the dosing chamber is smaller in the first position than in the second position. To provide a dosing pump, the dosing diaphragm of which has an increased service life and which as far as possible can be hydraulically operated even at very low dosing fluid pressures at the suction side it is proposed according to the invention that there is provided a prestressing device which prestresses the dosing diaphragm in the direction of the first or second position.

9 Claims, 1 Drawing Sheet

(51) Int. Cl.

| | |
|---|---|
| ***F04B 43/04*** | (2006.01) |
| ***F04B 43/073*** | (2006.01) |
| ***F04B 43/107*** | (2006.01) |

(56) References Cited

U.S. PATENT DOCUMENTS

| | | | | |
|---|---|---|---|---|
| 4,282,801 | A | 8/1981 | Basch et al. | |
| 2018/0163712 | A1* | 6/2018 | Hansmann | F04B 53/146 |

FOREIGN PATENT DOCUMENTS

| | | | |
|---|---|---|---|
| DE | 102004011123 | A1 | 3/2005 |
| EP | 0036886 | B1 | 5/1984 |

* cited by examiner

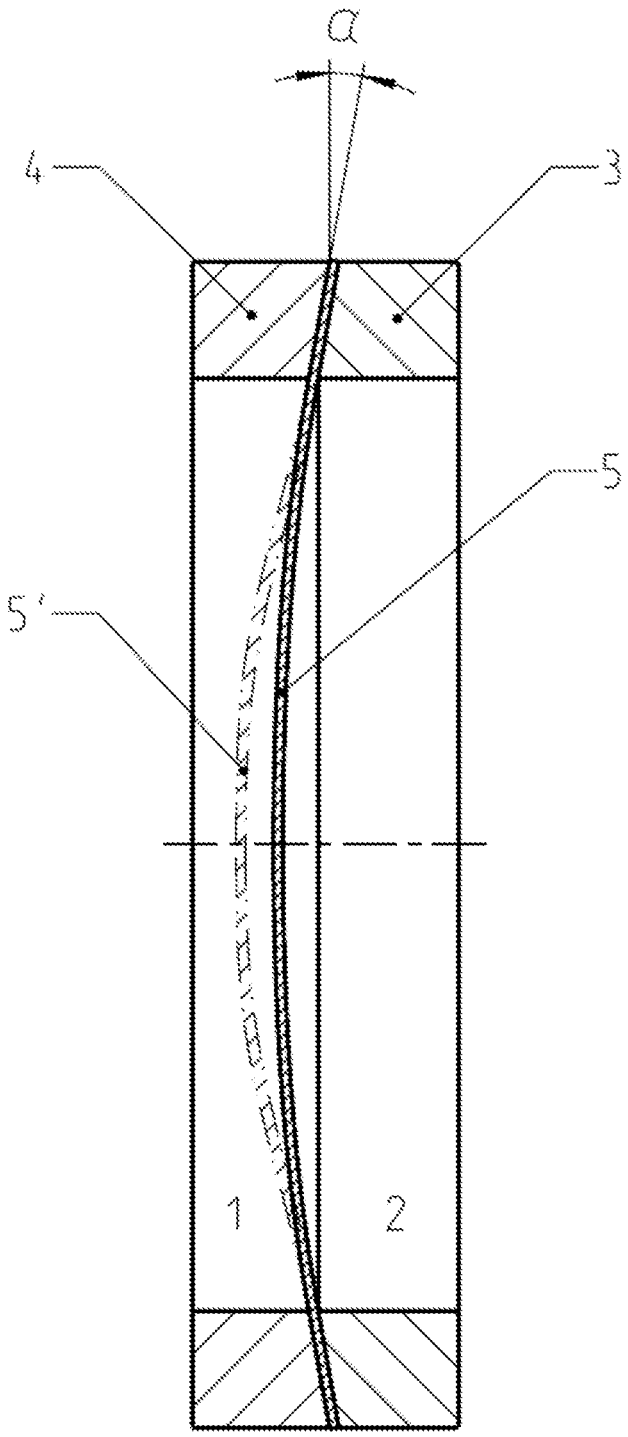
a
4
3
5
5'
1
2

DOSING PUMP WITH DOSING DIAPHRAGM

The present invention concerns a dosing pump comprising a dosing chamber, a working chamber and a dosing diaphragm, wherein the dosing chamber and the working chamber are separated from each other by the dosing diaphragm. In addition there is provided a device for reciprocating movement of the dosing diaphragm between a first position and a second position, wherein the volume of the dosing chamber is smaller in the first position than in the second position. In general the dosing chamber has two connections, namely a suction connection and a pressure connection which are respectively connected to a check valve. During a suction stroke, that is to say in a movement of the dosing diaphragm from the first position into the second position the check valve is connected to the pressure connection and dosing medium is sucked into the dosing chamber by way of the check valve at the suction connection.

During a pressure stroke, that is to say as soon as the direction of movement of the dosing diaphragm is reversed and it moves from the second position in the direction of the first position, the volume of the dosing chamber is reduced and the pressure in the dosing chamber is increased, which results in closure of the check valve at the suction connection and opening of the check valve at the pressure connection. The dosing medium can then be pushed out of the dosing chamber by way of the pressure connection. The described procedure is repeated as often as may be desired in order to draw in the dosing medium by way of the suction connection and deliver it by way of the pressure connection.

The moveable dosing diaphragm has be held in some form. In general the dosing diaphragm has edge regions at which it is gripped or clamped between two components. It is exposed to a high loading directly adjacent to the clamping or gripping region as the dosing diaphragm is always alternately bent or deformed in one direction or the other. That alternate bending provides for a continuous change between tensile and compressive stress in the material. Accordingly in the regions which adjoin the clamped edge regions of the dosing diaphragm it can suffer from notching, cracking and the like which ultimately lead to premature rupture of the dosing diaphragm.

In addition in the case of a hydraulic drive in which a hydraulic fluid disposed in the working chamber is oscillatingly put under pressure the movement of the dosing diaphragm in the direction of the first position can admittedly be easily implemented by increasing the hydraulic pressure, but the return movement to the second position is effected substantially by virtue of the fluid pressure provided by way of the suction connection in the dosing fluid to be delivered. That limits the area of application of the pump as there must always be a given minimum pressure applied at the suction connection in order to ensure a reliable return movement of the dosing diaphragm into the second position and thus reliable functioning of the pump.

Taking the described state of the art as the basing starting point therefore the object of the present invention is to provide a dosing pump, the dosing diaphragm of which has an increased service life and which as far as possible can be hydraulically operated even at very low dosing fluid pressures at the suction side.

According to the invention that object is attained in that there is provided a prestressing device which prestresses the dosing diaphragm in the direction of the first or second position.

The consequence of this is that even when there is no pressure difference between the working chamber and the dosing chamber a force is already exerted on the dosing diaphragm and the latter is elastically deformed.

The prestressing should preferably be so selected that, in contrast to the dosing diaphragms in the state of the art, the dosing diaphragm no longer involves a relieved state, but only between two positions which are both prestressed in the same direction. As a result the alternate bending effect is eliminated and therewith constant loading and unloading of the edge regions of the dosing diaphragm when it makes the transition from an outwardly curved state into an inwardly curved state. In addition the measure according to the invention ensures that, during the suction stroke, a force is always exerted on the dosing diaphragm in the direction of the second position so that the dosing pump can be hydraulically driven with very low dosing fluid pressures. In the case of the alternate bending effect which is otherwise usual, in contrast upon the change in the bending direction a force even has to be exerted on the dosing diaphragm by the dosing fluid in order to cause the dosing diaphragm to "tip over" from the dosing diaphragm state in which it is displaced in the direction of the first position into the state of being displaced in the direction of the second position.

Particularly preferably the prestressing device is of such a design configuration that the dosing diaphragm is prestressed in the direction of the first position. In that way the dosing diaphragm is urged in the direction of the first position at any time.

In a further preferred embodiment the device for reciprocating movement of the dosing diaphragm is a hydraulic device, wherein a hydraulic fluid is arranged in the working chamber, wherein the hydraulic device is of a such a design configuration that it can act on the hydraulic fluid with a hydraulic pressure to move the dosing diaphragm in the direction of the first position.

A further preferred embodiment provides that the dosing diaphragm comprises an elastic material, preferably metal. Due to the prestressing of the dosing diaphragm it is moved in the direction of the first position until the return force of the elastic material compensates for the prestressing force. Basically, the measure according to the invention means that the first and the second position of the dosing diaphragm are displaced by the provision of the prestressing device so that even in the second position in which the volume of the dosing chamber is greater the dosing diaphragm is always still prestressed or curved in the direction of the first position.

In a further preferred embodiment the dosing diaphragm comprises a flat metal foil. Such a flat metal foil has edge regions at which the dosing diaphragm is held by means of a gripping device. By way of example the gripping device can comprise two elements having mutually corresponding annular contact surfaces, between which the edge regions of the dosing diaphragm are arranged and clamped. When the dosing diaphragm is held at its edge regions it can be moved either in the one direction or the other by a force acting on the central region of the dosing diaphragm so that the dosing diaphragm curves in said direction.

In a particularly preferred embodiment the gripping device is of such a configuration that it functions as the prestressing device.

That can be effected for example by the corresponding contact surfaces being of a non-flat configuration. By way of example they can be of a curved configuration. In a particularly preferred embodiment the corresponding contact surfaces are conical or have conical surfaces, wherein the cone angle of the contact surfaces is preferably between 0° and 10° and best between 2° and 5°. If a flat metallic dosing diaphragm is clamped between such curved or conical contact surfaces that automatically leads to a prestressing. It is therefore possible to dispense with an additional force-applying element like for example a spring which presses against the diaphragm.

Further advantages, features and possible uses will be apparent from the description hereinafter of a preferred embodiment and the accompanying FIGURE in which:

FIG. 1 shows a diagrammatic cross-sectional view through the diaphragm and the gripping device according to a first embodiment of the invention.

The basic structure of the described dosing pumps is known to the man skilled in the art. FIG. 1 therefore only shows a cross-sectional view of a dosing diaphragm 5 which separates a dosing chamber 1 from a working chamber 2. The dosing diaphragm 5 is gripped at its edge regions between the gripping device 3, 4. The gripping device 3, 4 comprises two cylindrical elements 3, 4 with mutually facing contact surfaces, between which the edge regions of the dosing diaphragm 5 are clamped. As the contact surfaces are of a conical configuration with a cone angle $\alpha$ the dosing diaphragm 5 in the situation shown in FIG. 1 is curved towards the left when the two cylindrical elements 3, 4 of the gripping device are moved towards each other and the edge regions of the diaphragm are clamped. The dosing diaphragm is therefore prestressed towards the left in FIG. 1 by the gripping device.

In the preferred embodiment the working chamber 2 is filled with a hydraulic fluid which can be acted upon with a pressure by means of a suitable device like for example a driven piston. When the pressure in the working chamber 2 rises above the pressure in the dosing chamber 1 then the dosing diaphragm 5 is moved still further towards the left. That position is diagrammatically shown by the broken line 5'. When the pressure in the working chamber 2 is reduced the diaphragm moves back into the position again, that is shown by the solid line 5.

Alternate bending of the diaphragm is avoided by the prestressing of the diaphragm in accordance with the invention. In the case of the alternate bending loading which is usual in the state of the art microstructural changes occur, which lead to premature material fatigue. In the case of alternate bending a force-travel graph also does not exhibit the linear relationship usually to be expected for elastic materials (Hook's law) but shows hysteresis in the region of the bending alternation.

The alternate bending is prevented by the prestressing as now the movement of the diaphragm always takes place in the same direction.

LIST OF REFERENCES

1 dosing chamber
2 working chamber
3 gripping device
4 gripping device
5 dosing diaphragm

The invention claimed is:

1. A dosing pump comprising a dosing chamber, a working chamber, a dosing diaphragm comprising an elastic material having edge regions, and a gripping device having two mutually corresponding contact surfaces, the gripping device holding the dosing diaphragm at the edge regions, wherein the dosing chamber and the working chamber are separated from each other by the dosing diaphragm, wherein there is provided a device for reciprocating movement of the dosing diaphragm between a first position and a second position, wherein the volume of the dosing chamber is smaller in the first position than in the second position, wherein there is provided a prestressing device which prestresses the dosing diaphragm in the direction of the first or second position, wherein the prestressing device is configured so that when the dosing diaphragm is in the first position or the second position it is prestressed in the same direction, such that the dosing diaphragm no longer involves a relieved state, but moves only between two positions which are both prestressed in the same direction and the dosing diaphragm is elastically deformed in the same direction even when there is no pressure difference between the working chamber and the dosing chamber, characterized in that the gripping device is of such a configuration that the gripping device functions as the prestressing device, and wherein the dosing diaphragm is metal, wherein due to the prestressing of the dosing diaphragm the dosing diaphragm is moved in the direction of the first position until the return force of the elastic material compensates for the prestressing force.

2. A dosing pump according to claim 1 characterized in that the gripping device prestresses the dosing diaphragm in the direction of the first position.

3. A dosing pump according to claim 1 characterized in that the device for reciprocating movement of the dosing diaphragm is a hydraulic device and a hydraulic fluid is arranged in the working chamber, wherein the hydraulic device is of such a design configuration that it can act on the hydraulic fluid with a hydraulic pressure to move the dosing diaphragm in the direction of the first position.

4. A dosing pump according to claim 1 characterized in that the dosing diaphragm is a flat metal foil.

5. A dosing pump according to claim 2 characterized in that the corresponding contact surfaces are of a non-flat configuration.

6. A dosing pump according to claim 2 characterized in that the corresponding contact surfaces are of a curved configuration.

7. A dosing pump according to claim 2 characterized in that the corresponding contact surfaces are of a conical configuration having a cone angle.

8. A dosing pump according to claim 7 wherein the cone angle of the corresponding contact surfaces is between 0 degrees and 10 degrees.

9. A dosing pump according to claim 8 wherein the cone angle is between 2 degrees and 5 degrees.

* * * * *